US005195487A

United States Patent [19]

Zürner et al.

[11] Patent Number: 5,195,487

[45] Date of Patent: Mar. 23, 1993

[54] FUEL INJECTION SYSTEM FOR AIR-COMPRESSING INTERNAL COMBUSTION ENGINES

[75] Inventors: Hans-Jürgen Zürner, Ammerndorf; Dietmar Henkel, Neumarkt, both of Fed. Rep. of Germany

[73] Assignee: MAN Nutzfahrzeuge Aktiengesellschaft, Munich, Fed. Rep. of Germany

[21] Appl. No.: 805,206

[22] Filed: Dec. 10, 1991

[30] Foreign Application Priority Data

Dec. 10, 1990 [DE] Fed. Rep. of Germany ..... 4039304
Feb. 20, 1991 [DE] Fed. Rep. of Germany ..... 4105168

[51] Int. Cl.[5] ..... F02B 3/00; F02M 7/00
[52] U.S. Cl. ..... 123/300; 123/447
[58] Field of Search ..... 123/299, 300, 447, 446, 123/496

[56] References Cited

U.S. PATENT DOCUMENTS

| | | | |
|---|---|---|---|
| 3,507,263 | 4/1970 | Long | 123/456 |
| 4,029,071 | 6/1977 | Saito | 123/496 |
| 4,289,098 | 9/1981 | Norberg | 123/299 |
| 4,520,774 | 6/1985 | Sitter | 123/300 |
| 4,693,227 | 9/1987 | Satou | 123/300 |
| 4,711,209 | 12/1987 | Henkel . | |
| 5,054,445 | 10/1991 | Henkel | 123/300 |
| 5,103,785 | 4/1992 | Henkel | 123/299 |

FOREIGN PATENT DOCUMENTS

| | | | |
|---|---|---|---|
| 862958 | 3/1941 | France | 123/300 |

*Primary Examiner*—Carl S. Miller
*Attorney, Agent, or Firm*—Robert W. Becker & Associates

[57] ABSTRACT

The present invention relates to an injection system for air-compressing combustion engines. In order to reduce the combustion noise of diesel combustion engines it has been suggested to divide the injection step into a pre-injection and main injection. In order to improve the velocity of the injection quantity increase during partial load and/or at low revolutions per minute it is suggested that a pressure wave generator is arranged downstream of the injection pump and to further provide a volume reservoir in parallel to the pressure wave generator. The pressure wave generator ensures that the passage of the injection line is opened only when a predetermined pressure has been reached. After opening of the pressure wave generator the pressure will not drop as quickly since fuel will be supplied by the volume reservoir even when the injection pump has only a low piston velocity. A further advantage of the present invention is that the by-pass line may branch off at a metering piston unit so that due to the reflection of the pressure wave at the metering piston, generated by the pressure wave generator, a doubling of the pressure occurs.

14 Claims, 4 Drawing Sheets

FUEL INJECTION SYSTEM FOR AIR-COMPRESSING INTERNAL COMBUSTION ENGINES

BACKGROUND OF THE INVENTION

The present invention relates to a fuel injection system for air-compressing internal combustion engines, having an injection pump and an injection valve connected to one another by an injection line. The system is further comprised of a metering piston unit arranged before the injection valve and a time-delay member which is connected in parallel to the metering piston unit. The time-delay member is provided with a check valve that opens in the direction of the injection valve. The volume of a cylinder chamber of the metering piston unit corresponds to a pre-injection quantity of fuel.

According to U.S. Pat. No. 4,711,209 an injection system is known with which a division of the injection process into a pre-injection and a main injection is possible. For this purpose a metering piston unit is provided within the injection line, and connected in parallel thereto a time-delay unit is arranged. When a pressure wave generated by the injection pump is advancing in the injection line, it first reaches the metering piston unit and, against the force of a return spring, moves a metering piston, thereby supplying the injection valve with a fuel quantity that is delimited by the stroke of the metering piston and corresponds to the desired pre-injection. During the pre-injection step a check valve within the time-delay member is closed. Another portion of the pressure wave branches off before the metering piston unit via a time-delay member and reaches with a time delay, due to the difference in travel distance, the check valve and opens it against the force of a spring. Now the fuel from the time-delay line which corresponds to the main injection quantity may be injected via the injection valve into the combustion chamber. The time difference between the pre-injection and the main injection may be varied by the difference delay line. The main disadvantage of such an injection system is that, directly after the occurrence of the pressure wave impulse which initiates the main injection, the velocity with which the injection quantity increases during partial load and at low revolutions of the combustion engine is very low.

It is therefore an object of the present invention, for certain operational conditions of the combustion engine such as partial load and/or low revolutions of the engine, to substantially increase the velocity with which the injection quantity increases.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
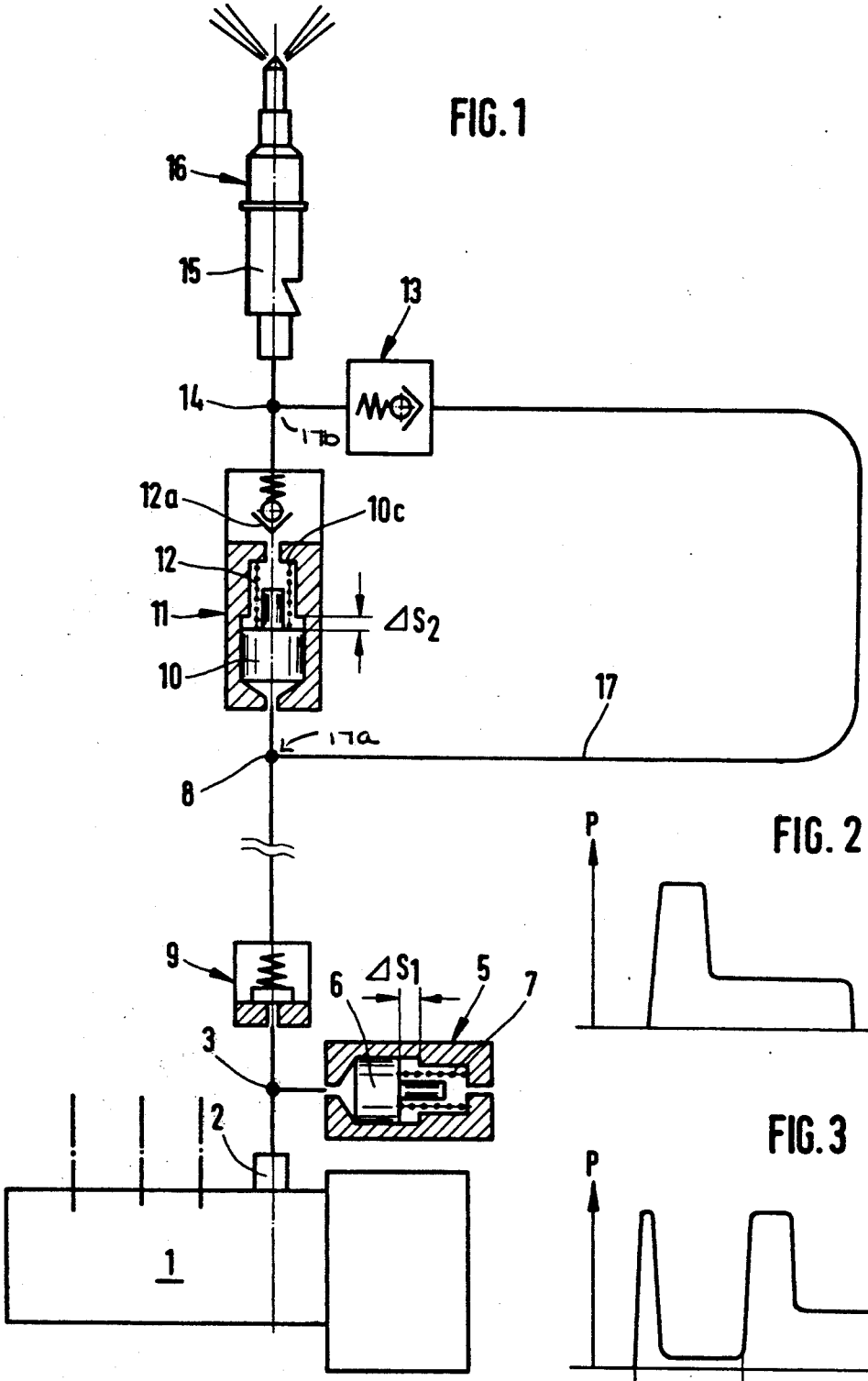
FIG. 1 shows a diagrammatic representation of the injection system with a branching for the time-delay member before the metering piston unit.
Figure 2:
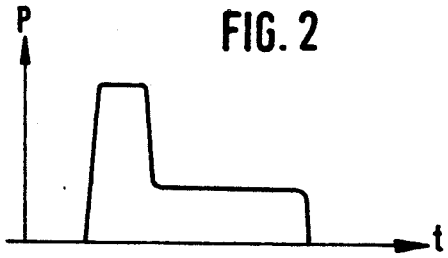
FIG. 2 shows the formation of a pressure impulse in the injection line after a pressure wave generator as a function of time.

The fuel injection system for air-compressing internal combustion engines of the present invention is primarily characterized by having an injection pump and an injection valve connected to one another by an injection line; a metering piston unit having a cylinder chamber and being connected in series between the injection pump and the injection valve within the injection line, with a cylinder volume of the cylinder chamber of the metering piston unit corresponding to a pre-injection quantity of fuel, and with the metering piston unit being arranged close to the injection valve; a time-delay member having an inlet and an outlet, and being connected in parallel to the metering piston unit, with the inlet of the time-delay member being connected to the injection line before the metering piston unit and with the outlet of the time-delay member being connected to the injection line at a position between the metering piston unit and the injection valve; a first check valve connected in series within the time-delay men ber before the outlet, the first check valve being open in a direction towards the injection valve; a pressure connection for connecting the injection pump to the injection line; a pressure wave generator connected in series between the pressure connection and the metering piston unit; and a volume reservoir branching off the injection line between the pressure connection and the pressure wave generator, with an actuating pressure of the volume reservoir being smaller than an actuating pressure of the pressure wave generator.

The cooperation of the metering piston unit and the volume reservoir results in a plurality of advantages. For example, an exact metering of the pre-injection quantity due to the working principle of the metering piston unit which "imprints" the exact amount of volume is ensured. The dimensioning expenditure for modeling the correct time function of the pressure drop that is desired between the pre-injection and the subsequent main injection, is almost entirely eliminated. Of great importance, however, is the achieved improvement of the main injection. Due to the greater volume provided as a result of the volume reservoir and as a result of the increased and longer lasting peak value at the inlet of the valve holder of the injection valve, substantial improvements with respect to the black smoke emission of the combustion engine are to be expected.

A further advantage lies in the fact that with the incentive system the selection of the slope of the cam is not subject to the previously known restrictions, for example, no defined time dependency of the pressure drop between the pre-injection and the main injection during the timely course of the pressure development downstream of the pressure wave generator is required. Thus, there are no more obstacles to overcome for the realization of a fast injection with the aid of the slope of the cam as a parameter which may be used over its entire range. An added advantage is furthermore the elimination of dampening fuction at the valve shaft of the pressure wave generator.

Another embodiment of the present invention is characterized by having an injection pump and an injection valve connected to one another by an injection line; a metering piston unit comprising a housing having a cylinder chamber and a piston positioned in this cylinder chamber, the metering piston unit connected in series between the injections pump and the injection valve within the injection line, with a volume of the cylinder chamber corresponding to a pre-injection quantity of fuel, the metering piston unit further having a control opening that connects to the cylinder chamber, and the metering piston unit being arranged close to the injection valve; a time-delay member having an inlet and an outlet, and being connected in parallel to the metering piston unit, with the inlet of the time-delay member being connected to the control opening of the metering piston unit, when the piston of the metering piston unit is displaced from a resting position thereof by a given distance, and with the outlet being connected to the injection line at a position between the metering piston unit and the injection valve; a first check valve connected in series within the time-delay member before the outlet, the first check valve being open in a direction towards the injection valve; a pressure connection for connecting the injection pump to the injection line; a pressure wave generator connected in series between the pressure connection and the metering piston unit; and a volume reservoir branching off the injection line between the pressure connection and the pressure wave generator, with an actuating pressure of the volume reservoir being smaller than an actuating pressure of the pressure wave generator.

Due to the fact that the time-delay member is connected with its inlet to a control opening at the metering piston unit which is initially closed by the piston and accordingly reflects the pressure wave that is generated by the pressure wave generator and is running via the injection line towards the piston, so that due to the reflection a doubling of the pressure results which, in return, also doubles the force acting on the piston. The time difference between the respective beginning of the pre-injection and main injection is the sum of respective portions as explained in detail below: The first portion is the time needed by the piston for the displacement of the pre-injection quantity until the control opening is finally opened or released, and the second portion corresponds to the time which is needed for the entire opening of the control opening plus the travel time of the pressure wave, which initiates the main injection, for paning through the time-delay member. The response time of the piston for the opening of the control opening remains always constant since, due to the upstream pressure wave generator, a constant pressure is maintained at the inlet of the metering piston unit.

In both embodiments the time-delay member may be in the form of a by-pass line or in the form of a plurality of Helmholtz resonators in a serial connection. In a first alternative the Helmholtz resonators may be comprised of first and second cylindrical disks, with the first cylindrical disks having a concentric bore and with the second disks having a frustum-shaped bore, the first and second disks being stacked such that subsequent to one of the first disks two of the second disks are arranged, with the two second disks being positioned mirror-symmetrical to one another so that the frustum-shaped bores thereof form a respective resonance volume of the Helmholtz resonator. It is also possible (second alternative) that the serial connection of the Helmholtz resonators is in the form of a cylindrical body having an axially extending central bore and a plurality of radially extending bores spaced at a distance from one another, the radially extending bores forming a respective resonance volume of the Helmholtz resonators. The first alternative is characterized by a reduced length. Especially advantageous is, however, the reduced volume. A great volume, during compression, results in high volume changes which is detrimental to a shorter, delay-free injection. Due to the stacked arrangement of identical elements the production costs are reduced. The second alternative is characterized by even lower production costs.

It is preferable that the volume reservoir in both embodiments is comprised of a cylinder and a displacement piston axially slidably arranged in the cylinder, the displacement piston being pre-stressed by a spring, with a pre-stress of the spring being selected such that the actuating pressure of the displacement piston is smaller than the actuating pressure of the pressure wave generator.

It is preferred that the fuel injection system comprises a second check valve provided downstream of the metering piston unit, allowing fuel flow only in the direction of the injection valve: The metering piston unit in the first embodiment preferably further comprises a housing and a piston that is axially slidably guided in the housing. It is preferred that in both embodiments the metering piston unit has a pressure spring disposed inside the housing for maintaining the piston in a resting position thereof, with a stroke of the piston being limited by an abutment provided at the housing.

In both embodiments the pressure wave generator preferably comprises a valve holder, a valve body, a valve piston, and a control member, the control member being supplied with fuel from the injection pump via an inlet bore of the pressure wave generator. The inlet bore ends in a pressure chamber of the pressure wave generator. The piston may be supplied with a selected hydraulic pressure via a bore of the pressure wave generator. Preferably, the control member is comprised of a valve shaft that opens and closes an outlet bore of the pressure wave generator in the direction of fuel flow. The valve shaft is comprised of a cylindrical portion and a conical portion so that a surface area corresponding to a difference of a diameter of a base of the conical portion and a diameter of a top of the conical portion, when exposed to fuel pressure, is sufficient to open the control member at a selected fuel pressure against a force of the valve piston generated pre-injection the hydraulic pressure.

By adjusting the force of the spring to the surface of the piston it is possible that the actuating pressure of the volume reservoir is always smaller than the actuating pressure of the pressure wave generator, so that after actuation of the pressure wave generator a sufficient pressure and fuel volume may be supplied within a short period of time.

DESCRIPTION OF PREFERRED EMBODIMENTS

The present invention will now be described in detail with the aid of several specific embodiments utilizing FIGS. 1 through 8.

FIG. 1 shows a schematic representation of the first embodiment of the inventive injection system. Fuel which is supplied by a respective pump element of an injection pump 1 passes through the pressure connection 2 and, while passing a first branching point 3, generates, due to its compressibility, a pressure within the sections of the injection line 9 upstream of the pressure wave generator 4. The sections of the injection line are to be considered as a pre-reservoir. The pressure generated in the injection line 9 corresponds to the actuating pressure of the volume reservoir 5. When, during the further course of the pumping process, the pressure reaches the actuation pressure of the displacement piston 6, it is displaced by a stroke Δs1 and opens a respective reservoir volume for storing the presently pumped fuel. When due to the further pumping of fuel the pressure within the volume reservoir 5 increases to the actuation pressure of the pressure wave generator 4, the amount of fuel that has been collected within the volume reservoir 5 is released with the assistance of a spring 7 acting on the displacement piston 6. Thus, another pressure wave is generated within the section of the injection line 9 upstream of the pressure wave generator 4. The amount of fuel collected or stored within the volume reservoir 5 may not exceed the fuel quantity required at the lower idling range of the combustion engine. The resulting formation of the continuing pressure impulse is represented as a function of time in FIG. 2. It is clearly shown therein that the pressure drop which was required with systems of the prior art has been eliminated.

After the pressure wave has passed the section of the injection line 9 between the first branching point 3 and the second branching point 8 the energy of the pressure wave is divided into two portions.

The first portion acts on a piston 10 of a metering piston unit 11 and causes the formation of a pre-injection fuel quantity. The piston 10 is pre-stressed by a pressure spring 12 which exerts only a small force onto the piston 10 and serves only to return the piston 10 into its resting position. This must be achieved within a time span that is shorter than the duration of the working cycle of the engine at the upper range of the number of revolutions. The diameter and the travel distance Δs2 of the piston 10 define the volume of the pre-injection quantity. Along its course the fuel of the pre-injection quantity passes first a second check valve 12*a* and reaches then via a third branching point 14 the valve holder 15 of the injection valve 16 where the fuel is atomized. The flow of portions of the pre-injection fuel quantity into the time-delay member (in the form of a bi-pass line 17) is suppressed effectively by the action of a first check valve 13. Both check valves 12*a* and 13 have a choke bore in order to provide a pressure release of sections of the injection line 9 in the downstream direction, inclusive the valve holder 15, within the duration of a working cycle; this corresponds to the action of a low-adjusted pressure-equalizing valve.

The other portion of the pressure wave which has reached the second branching point 8 of the injection line 9 enters the by-pass line 17 via the inlet 17*a*, opens the first check valve 13 that is arranged at the end of the by-pass line 17 close to the outlet 17*b*, and, since the entrance into the metering piston unit 11 is prevented by the check valve 12*a*, enters then the valve holder 15 to thereby initiate the main injection under very high pressure, i.e., the pressure is doubled due to wave superposition.

Figure 3:
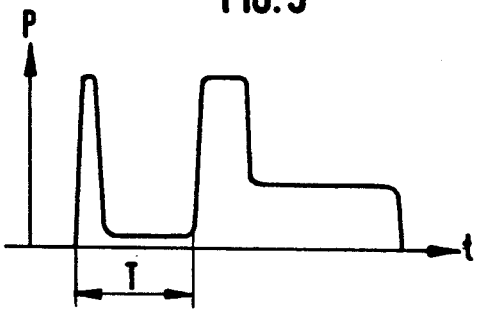
FIG. 3 shows the formation of the pressure as a function of time within the annular chamber of an injection valve for pre-injection and main injection of a system according to the diagrammatic representation of FIG. 1.

FIG. 3 shows the resulting time dependency of the pressure within the annular chamber of the injection valve 16, whereby "T" represents the time of the pressure wave within the by-pass line, respectively, the time-delay circuit. It is clearly shown that the pressure drop within the time period between the two wave-mechanically generated pressure peaks is influenced by the process of the base pressure formation only to a small extent. Besides the high velocity of the pressure increase during the build-up phase of the main injection, the high pressure level which occurs simultaneously, is very desirable. These characteristics are necessary requirements for the realization of the aforementioned lowering of the black smoke emission with respect to injection systems which do not contain a pressure wave generator.

A further improvement of output and efficiency of the aforementioned injection system of the present invention, including the fuel atomizing characteristics, as compared to systems relying solely on a pressure reservoir with electronically controlled pressure release valves as a supply means, may be realized with an increased expenditure as follows:

With a spindle drive or a simple cam-roller shaft-system (both versions being actuated by a control member in the form of a positioning action circuit with an electronically controlled geared engine) a pin abutment for the displacement piston 6, as a constituent of the volume reservoir 5, must be influenced such that the travel distance Δs1 of the displacement piston 6 and thus the volume of fuel, which is stored under high pressure, corresponds to the presently required injection quantity needed by the diesel engine. The metering of the reservoir volume corresponding to respective engine conditions is achieved by a performance range control system (in dependency of the two variables "load requirement" and "numbers of revolutions" of the engine) of the predetermined value for the travel distance Δs1 of the aforementioned positioning action circuit.

It should be noted that the combination of individual functions of the pressure wave generator 4, the volume reservoir 5, the metering piston unit 11, and the two check valves 12*a* and 13, optionally also the valve holder 15, to a respective compact unit (for minimizing the mounting expenditures) may be desirable for practical applications. This would also be advantageous with respect to the pressure wave behavior of the system that, due to the reduced "parasitic" reservoir volume of unnecessarily long line connections, suggests a desirable improvement with respect to the intermittent transmission behavior.

It is understood that reflected pressure waves resulting from local points of discontinuity of the wave resistance within the injection system may be suppressed with the aid of known instruments or relief measures in order to prevent so-called after-injection. In general, these relief measures are in the form of hardware components such as relief or pressure-equalizing valves which, when needed, are combined with a non-return valve and are positioned within the pressure connection 2 of the injection pump 1 (see FIG. 1).

With respect to the realization of the time-delay member it is expedient to replace the by-pass line 17 with an alternative time-delay member which, besides a substantially reduced design length, has a reduced fuel volume. The latter feature is important since the realization of a desired shorter injection time always encounters difficulties when the fuel volume which is present within the injection line system is relatively large. This results from the fact that due to the fuel compressibility the hydraulic substitute spring action of the fuel volume enclosed in the injection line shows an increased softness with increasing fuel volume so that the impulse excitation, i.e., the initiation of the plunger movement, results in an increased occurrence of hydraulic vibrations within the injection line. Accordingly, this requires an increased expenditure with respect to the suppression of these phenomena.

Time-delay members as described above are comprised of an alternating sequence of short line sections and miniature volume in the direction of fuel flow, respectively, of the passage of the pressure wave. Thus, they are comprised essentially of a chain or serial connection of individual subsequently arranged hydraulic Helmholtz resonators.

The dimensioning parameters for the dimensioning of the individual resonators comprise, besides the length and diameter of the resonance tube, the volume of the resonance chamber with which, in a known manner, simultaneously the resonance frequence of the Helmholtz system may be determined. With the resonance frequency the transmission characteristics of the entire travel time course such as front slope of the pressure wave in dependency of the number of resonators, travel time of the pressure wave and also the volume of fuel may be deducted or pre-determined.

The required number of sequentially arranged Helmholtz resonators may be determined according to the following equation $$n = \left(\frac{t}{ta}\right)^{1.5}.$$

$\Delta t$ in this formula corresponds to the desired time delay between pre-injection and main injection while ta corresponds to the desired average time for the pressure increase of the pressure wave after completion of the travel time course. The resonance frequency of the individual oscillators is determined by the following equation $f_0 = 0.5 \cdot ta^{-1.5} \cdot \Delta t^{0.5}$. The equation for the approximate determination of the resonance frequency based on the geometric dimensions of resonance tube and resonance chamber is as follows $$f_o = \frac{C}{2\pi} \cdot \sqrt{\frac{A}{V \cdot S}}.$$

Here, C represents the velocity of sound in the diesel fuel, A corresponds to the cross section of the resonance channel, V corresponds to the volume of the resonance chamber, and S (FIG. 4) corresponds to the resonance channel length.

The aforedescribed delay behavior of the travel time course is only valid for such frequency components of the pressure wave which have a frequency lower than the resonance frequency of the individual Helmholtz resonators. This demonstrates the important relation between the change in steepness of the pressure wave leaving the time-delay member and the selected resonance frequency of the Helmholtz resonators essential for the dimensioning of the system. Frequency portions of the pressure wave to be delayed having a frequency identical to or greater than the Helmholtz resonance frequency excite the first members of the chain to produce oscillations, or are suppressed. In practical applications this does not mean a restriction of the use of the concept, especially, since, due to the selection of flow-mechanically fast dampening of the individual oscillators, the dampening decrement of the excited oscillations may be influenced with respect to shorter fading times.

Figure 4:
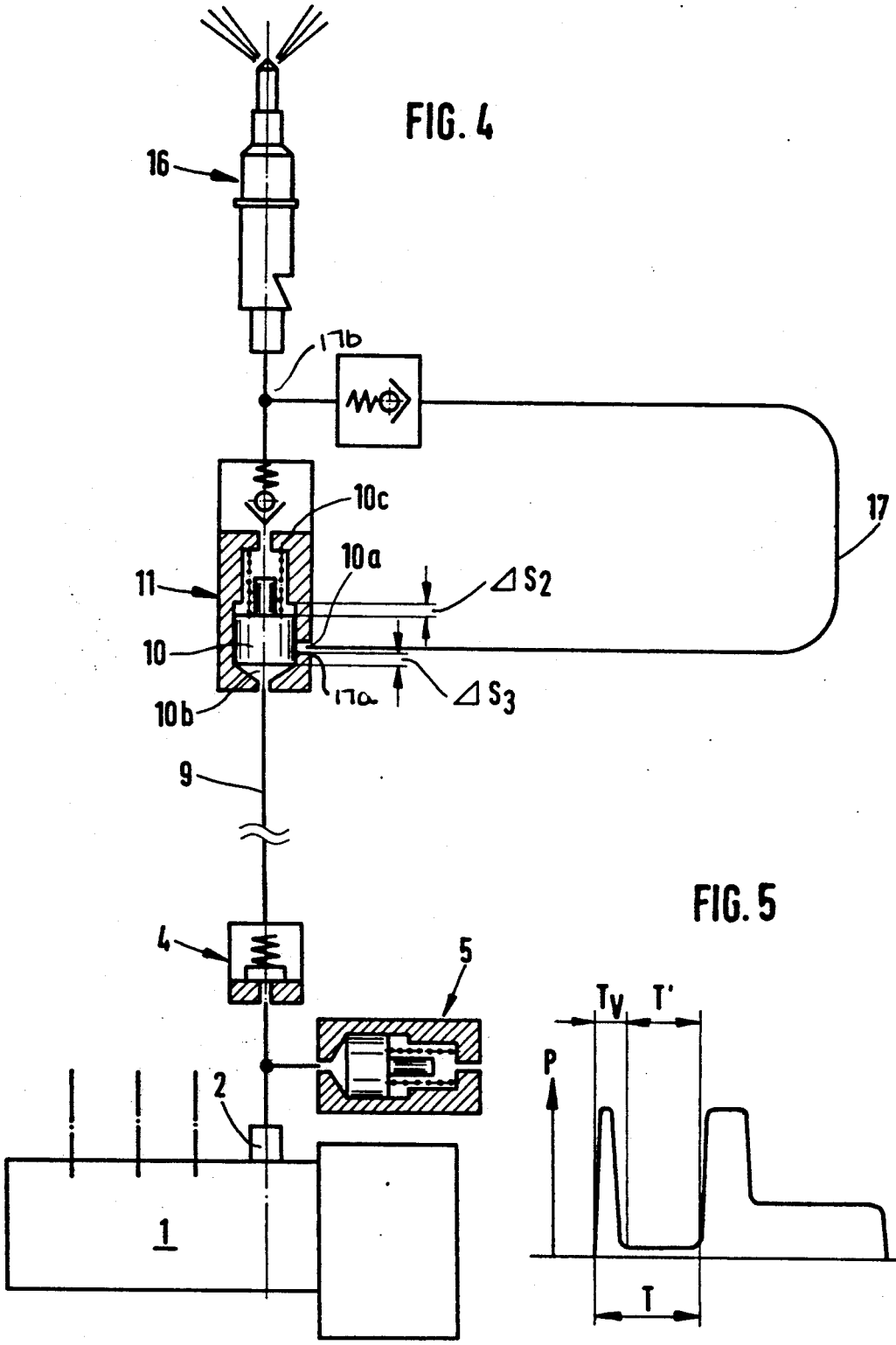
FIG. 4 shows a diagrammatic representation of an injection system having a branching for a time-delay member at the metering piston unit.
Figure 5:
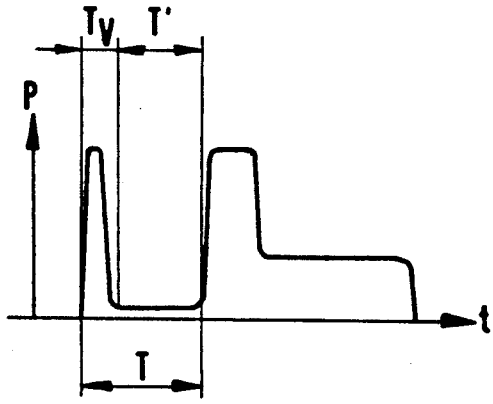
FIG. 5 shows the formation of pressure as a function of time within the annular chamber of an injection valve for pre-injection and main injection according to the diagrammatic representation of FIG. 4.

An alternative solution for improvement of the high pressure-hydraulic system properties of the time-delay member with respect to an improved atomization of the fuel may be taken from FIG. 4. The by-pass line 17 does not branch off the injection line 9 before the metering piston unit 11, but directly via a control opening 10*a* from the cylinder chamber 10*b* of the metering piston system 11. The edge of the control opening 10*a* which is first exposed during the movement of the piston 10 away from its resting position is recessed relative to the effective control edge of the piston 10 by a distance $\Delta S_3$. The stroke of the piston 10 is limited, as can be seen in the variant according to FIG. 1, to a travel distance $\Delta S_2$ by an abutment 10*c*. The other features of the injection system correspond to those of FIG. 1.

The special advantage of the system represented in FIG. 4 lies in the fact that the pressure wave, originating at the pressure wave generator 4 and continuing towards the metering piston system 11, is reflected at the piston 10 so that the effective pressure at this location is doubled due to the superposition rule. This pressure results in an increase of the displacement velocity of the piston 10 which results in an improved atomization of the fuel during the pre-injection. It is furthermore advantageous, as will be described in detail infra, that the accordingly reduced travel time of the front of the pressure wave of the main injection allows for the reduction of the active length of the time-delay member 17. The control cross-section, which is required for the opening of the main injection and is represented by the stroke of the piston $\Delta S_2$-$\Delta S_3$, must be kept as small as possible by providing a circumferential annular groove within the metering piston unit 11 for transferring the fuel into the radial bore 10*a* which feeds into the time-delay member 17 in order to provide a maximized pressure steepness over time of the front flank of the main injection. The movements of the piston 10 over time is normed by the pressure wave generator 4 since the generator 4 always provides a constant pressure.

The desired pre-injection quantity is defined by the cylinder chamber 10*b* as the product of the piston cross section and the stroke $\Delta S_2$ of the piston 10.

In the following paragraphs the function of the system will be described in detail.

After the pre-injection quantity has been metered by the piston 10 and the displacement of the piston 10 in the direction towards the injection valve 16 has taken place, an end of the piston 10 that is facing the injection pump 1 opens the control opening 10*a* within the metering piston unit 11 so that the control opening 10*a* is supplied via a distributing groove that is provided downstream at the inner cylinder mantle surface and which also assumes a control edge function. Since the control opening 10*a* is connected at its with the inlet 17*a* of the by-pass line 17 the fuel which initiates and maintains the main injection may pass the time-delay member 17 only when the piston 10 has reached its end position at the abutment 10c. The accordingly resulting consequences are the following:

As long as the pressure wave generated by the pressure wave generator 4 actuates the piston 10 into its displacement position the metering piston unit 11 acts in a wave-mechanical sense as a hydraulic sound-hard reflection board with the well-known property of generating a pressure doubling within the area of the pressure-engaging surface of the piston 10. The aforementioned pressure doubling, which occurs until the control opening 10a opens, advantageously results in an increase of the displacement velocity of the piston 10 which in return contributes to an improved atomization of the pre-injection fuel. When, due to a accordingly selected dimensioning, the duration of the pressure wave generated by the pressure wave generator 4 is identical or greater than the displacement duration Tv (see FIG. 5) of the piston 10, then a rest portion of the potential energy of the pressure wave resulting from the pressure doubling may be used simultaneously for the increase of the steepness of the pressure front (the initial phase) of the main injection, resulting in further improved atomization characteristics.

A disadvantage of the previous solution was that the time-delay member had to be designed for a pressure wave time T (FIG. 3). This time is now shortened according to FIG. 5 by the amount Tv which corresponds to the piston displacement movement. The resulting travel time for the pressure wave is thus the amount T'. Contrary to the representation of FIG. 3 the percentage-wise reduction of the travel time of the pressure wave within the hydraulic time-delay member is substantially greater than represented in FIG. 5 by the ratio of T' to T.

The reduction of length and filling volume of the hydraulic time-delay member which goes hand in hand with the resulting shorter travel time T' is desirable because the pressure-dependent volume compressibility of the fuel within the injection line (high pressure portion) is reduced. The required consistency (reproducability) of the travel time of the piston displacement Tv, i.e., its independence from the complete injection quantity per working cycle, cylinder as well as the numbers of revolutions of the engine, is ensured due to the forced constant energy content of the pressure wave generated by the pressure wave generator 4 (see FIG. 1, FIG. 4).

Figure 6:
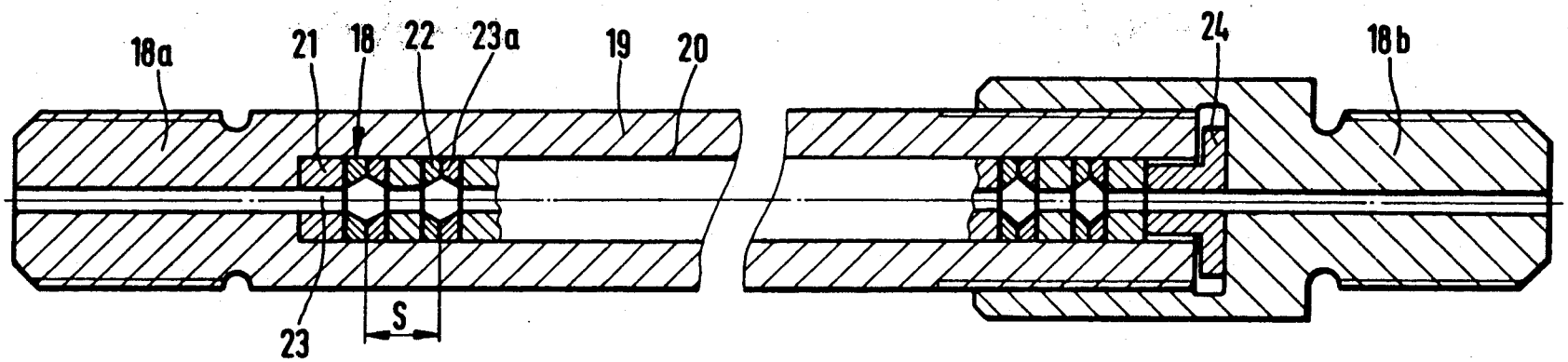
FIG. 6 shows a time-delay member in a stacked construction.

FIG. 6 shows an example of Helmholtz resonators 18 employed in the aforementioned chain. These Helmholtz resonators 18 are guided in a tube 19 which on one side is closed off by a first connector 18a. A cylindrical bore 20 is filled with first and second disks 21 and 22 in an alternating fashion as shown in FIG. 6. Each one of the first disks 21 has a concentric bore 23 corresponding to the bores of the connectors 18a and 18b, and corresponding to the inner diameter of the connected fuel lines. The second disks 22 which are arranged in pairs mirror-symmetrically relative to one another, have a frustum-shaped bore 23a and thus form the resonance volume of the individual Helmholtz resonators 18, while the bore 23 of the disks 21 serve as the respective resonance tube. The remaining end of the tube 19 is closed off by the connector 18b which is screwed on and which, together with the insert 24, serves to prestress the staggered disks 21, 22 in order to prevent radial capillary slits at the contact surfaces of the disks 21, 22.

Figure 7:
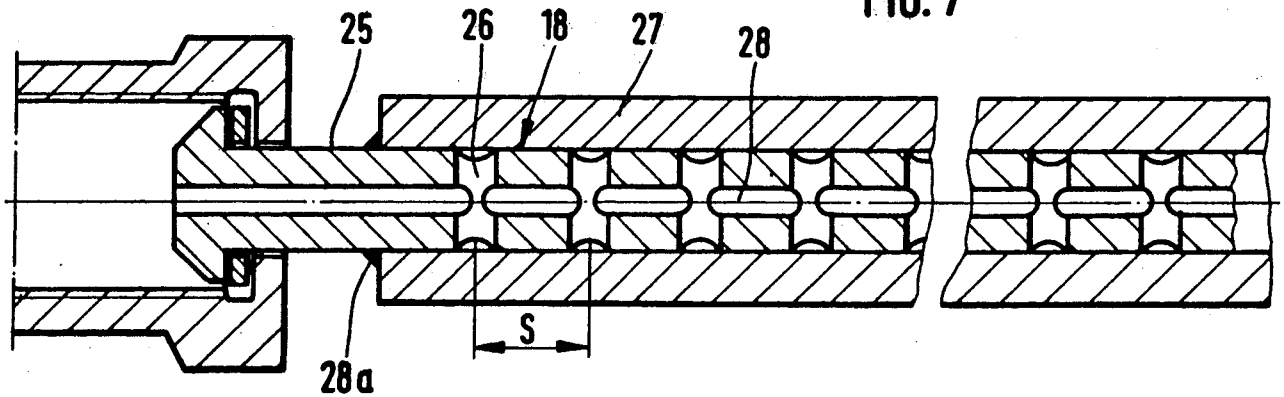
FIG. 7 shows a time-delay member having a central bore and radial bores for dividing the central bore.

FIG. 7 shows a further embodiment of a chain of Helmholtz resonators 18 as the time-delay member 17 which is characterized by low production costs. Due to the symmetry of the system only one half is represented in FIG. 7. An important part of this embodiment is a cylindrical body 25 which is provided with an axially extending central bore 28. Spaced at a distance S from one another radial bores 26 extend through the cylindrical body 25. A tube 27 is shrink-fitted onto the cylindrical body 25 and both ends are sealed by respective soldering points 28a for reliably sealing the system against fuel leakage. The volume defined by each individual radial bore 26 is the resonance volume of the corresponding Helmholtz resonator 18 which interacts with portions of the central bore 28 between two neighboring radial bores 26 serving as a resonance tube. At the connecting points of the radial bores 26 with the central bore 28 the sharp edges must be smoothed with suitable means in order to prevent cavitation. This may be achieved by zone-selective electro-chemical cutting or sand blasting with the aid of a window pair as a component of a sleeve which is axially slidable on the outer mantle surface of the tube 27 in order to provide for a selective exit of the two radially exiting sand flows.

Figure 8:
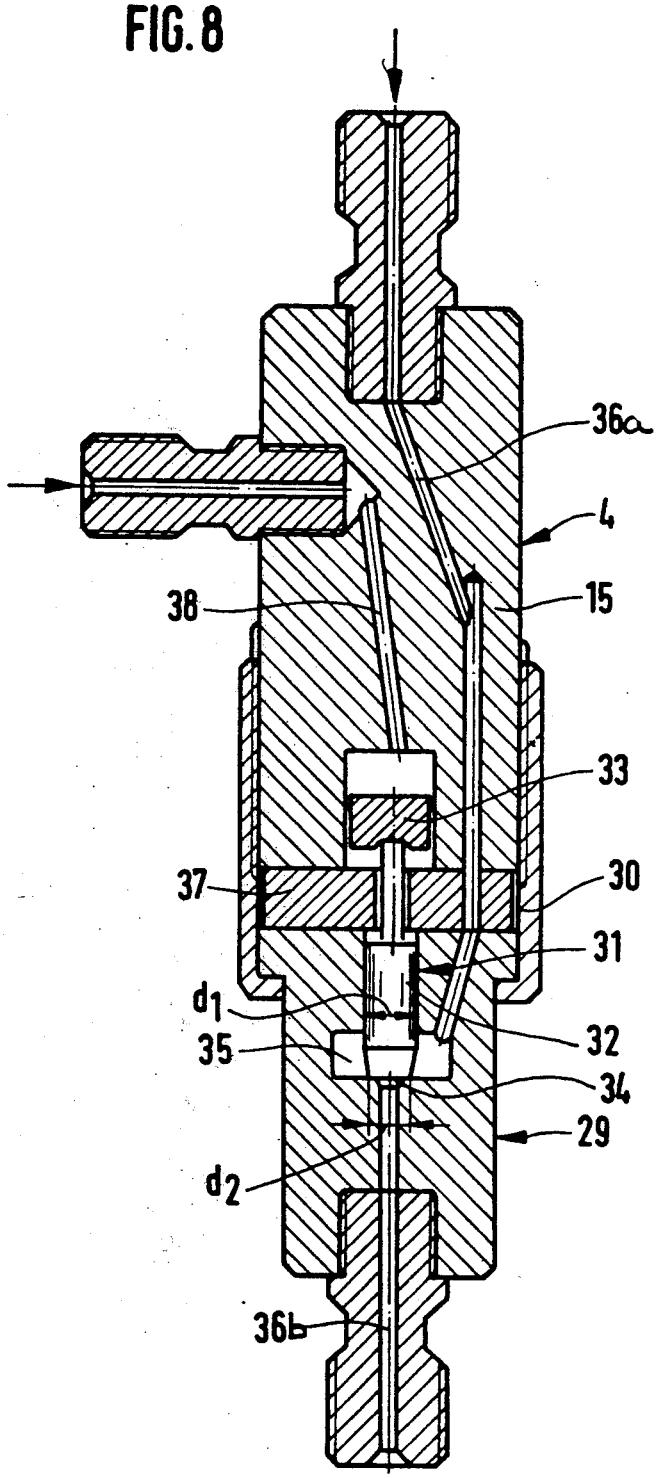
FIG. 8 is the representation of a pressure wave generator.

A constructive embodiment of a pressure wave generator 4 is represented in FIG. 8. The pressure wave generator 4 is similar in its design to an injection valve, however, it differs in its function by having a much greater ratio of actuating pressure to closing pressure. The pressure wave generator 4 is comprised of a valve holder 15, a valve body 29, and a sleeve nut 30 which connects the two parts 15 and 29. The valve body 29 is provided with a control member 31 which is axially guided therein. The control member 31 is comprised of a valve shaft 32 and a piston 33 which is in loose contact with the valve shaft 32.

The valve shaft 32 has a diameter d1 and is provided with a frustum-shaped portion which has a planar sealing surface 34 of a diameter d2. The sealing surface 34 seals a pressure chamber 35 against an outlet bore 36b. The pressure chamber 35 coaxially surrounds the valve shaft 32 whereby the pressure chamber 35 is connected via an inlet bore 36a with the exit of the injection pump 1 (FIG. 1). For limiting the axial movement of the control member 31 an abutment is provided at a coupling plate 37 which is clamped between the valve holder 15 and the valve body 29.

In order to provide a maximum flexibility with respect to controlling the control member 31 it is advantageous to connect the piston 33 via a bore 38 with a performance range controlled auxiliary pressure source (not represented in the drawing). A simpler, less sophisticated solution for the generation of the closing force at the valve shaft 32 may be achieved by providing a prestressed pressure spring instead of the piston 33 actuated by an auxiliary pressure means. The pre-stress force of the pressure spring is selected to be within the range of the force of the piston 33.

The present invention is, of course, in no way restricted to the specific disclosure of the specification and drawings, but also encompasses any modifications within the scope of the appended claims.

What we claim is:

1. A fuel injection system for air-compressing internal combustion engines, having an injection pump and an injection valve connected to one another by an injection line; said fuel injection system comprising:

a metering piston unit, being arranged close to said injection valve, comprising a housing having a cylinder chamber and a piston positioned in said cylinder chamber, said metering piston unit connected in series between said injection pump and said injection valve within said injection line, with a volume of said cylinder chamber corresponding to a pre-injection quantity of fuel, said metering piston unit further having a control opening that connects to said cylinder chamber;

a time-delay member having an inlet and an outlet, and being connected in parallel to said metering piston unit, with said inlet of said time-delay member being connected to said control opening of said metering piston unit, when said piston of said metering piston unit is displaced from a resting position thereof by a given distance, an with said outlet being connected to said injection line at a position between said metering piston unit and said injection valve;

a first check valve connected in series within said time-delay member before said outlet, said first check valve being open in a direction towards said injection valve;

a pressure connection for connecting said injection pump to said injection line;

a pressure wave generator connected in series between said pressure connection and said metering piston unit, said pressure wave generator comprising:

a valve holder, a valve body, a valve piston, and a control member, said control member being supplied with fuel from said injection pump via an inlet bore of said pressure wave generator, said inlet bore ending in a pressure chamber of said pressure wave generator, and said piston being supplied with a selected hydraulic pressure via a bore of said pressure wave generator;

said control member being comprised of a valve shaft that opens and closes an outlet bore of said pressure wave generator in the direction of fuel flow, said valve shaft being comprised of a cylindrical portion and a conical portion, so that a surface area corresponding to a difference of a diameter of a base of said conical portion and a diameter at a top of said conical portion, when exposed to fuel pressure, is sufficient to open said control member at a selected fuel pressure against a force of said valve piston generated by said hydraulic pressure; and a volume reservoir branching off said injection line between said pressure connection and said pressure wave generator, with an actuating pressure of said volume reservoir being smaller than an actuating pressure of said pressure wave generator.

2. A fuel injection system for air-compressing internal combustion engines, having an injection pump and an injection valve connected to one another by an injection line; said fuel injection system comprising:

a metering piston unit having a cylinder chamber and being connected in series between said injection pump and said injection valve within said injection line, with a cylinder volume of said cylinder chamber of said metering piston unit corresponding to a pre-injection quantity of fuel, said metering piston unit being arranged close to said injection valve;

a time-delay member having an inlet and an outlet, and being connected in parallel to said metering piston unit, with said inlet of said time-delay member being connected to said injection line before said metering piston unit and with said outlet of said time-delay member being connected to said injection line at a position between said metering piston unit and said injection valve, said time-delay member being in the form of a plurality of Helmholtz resonators in a serial connection;

a first check valve connected in series within said time-delay member before said outlet, said first check valve being open in a direction towards said injection valve;

a pressure connection for connecting said injection pump to said injection line;

a pressure wave generator connected in series between said pressure connection and said metering piston unit; and a volume reservoir branching off said injection line between said pressure connection and said pressure wave generator, with an actuating pressure of said volume reservoir being smaller than an actuating pressure of said pressure wave generator.

3. A fuel injection system according to claim 1, wherein said time-delay member is in the form of a by-pass line.

4. A fuel injection system according to claim 2, wherein said Helmholtz resonators are respectively comprised of first and second cylindrical disks, with said first cylindrical disks having a concentric bore and with said second disks having a frustum-shaped bore, said first and second disks being stacked such that subsequent to one of said first disks two of said second disks are arranged, with said two second disks being positioned mirror-symmetrical to one another so that said frustum-shaped bores thereof form a respective resonance volume of said Helmholtz resonators.

5. A fuel injection system according to claim 2, wherein said serial connection of said Helmholtz resonators is in the form of a cylindrical body having an axially extending central bore and a plurality of radially extending bores spaced at a distance from one another, said radially extending bores forming a respective resonance volume of said Helmholtz resonators.

6. A fuel injection system according to claim 2, wherein said volume reservoir is comprised of a cylinder and a displacement piston axially slidably arranged in said cylinder, said displacement piston being prestressed by a spring, with a pre-stress of said spring being selected such that said actuating pressure of said displacement piston is smaller than said actuating pressure of said pressure wave generator.

7. A fuel injection system according to claim 2, further comprising:

a second check valve provided downstream of said metering piston unit, allowing fuel flow only in the direction of said injection valve; and wherein said metering piston unit further comprises:

a housing and a piston that is axially slidably guided in said housing;

a pressure spring disposed inside said housing for maintaining said piston in a resting position thereof, with a stroke of said piston being limited by an abutment provided at said housing.

8. A fuel injection system for air-compressing internal combustion engines, having an injection pump and an injection valve connected to one another by an injection line; said fuel injection system comprising:

a metering piston unit having a cylinder chamber and being connected in series between said injection pump and said injection valve within said injection line, with a cylinder volume of said cylinder chamber of said metering piston unit corresponding to a pre-injection quantity of fuel, said metering piston unit being arranged close to said injection valve;

a time-delay member having an inlet and an outlet, and being connected in parallel to said metering piston unit, with said inlet of said time-delay member being connected to said injection line before said metering piston unit and with said outlet of said time-delay member being connected to said injection line at a position between said metering piston unit and said injection valve;

a first check valve connected in series within said time-delay member before said outlet, said first check valve being open in a direction towards said injection valve;

a pressure connection for connecting said injection pump to said injection line;

a pressure wave generator connected in series between said pressure connection and said metering piston unit, said pressure wave generator comprising:

a valve holder, a valve body, a valve piston, and a control member, said control member being supplied with fuel from said injection pump via an inlet bore of said pressure wave generator, said inlet bore ending in a pressure chamber of said pressure wave generator, and said piston being supplied with a selected hydraulic pressure via a bore of said pressure wave generator;

said control member being comprised of a valve shaft that opens and closes an outlet bore of said pressure wave generator in the direction of fuel flow, said valve shaft being comprised of a cylindrical portion and a conical portion, so that a surface area corresponding to a difference of a diameter of a base of said conical portion and a diameter at a top of said conical portion, when exposed to fuel pressure, is sufficient to open said control member at a selected fuel pressure against a force of said valve piston generated by said hydraulic pressure; and a volume reservoir branching off said injection line between said pressure connection and said pressure wave generator, with an actuating pressure of said volume reservoir being smaller than an actuating pressure of said pressure wave generator.

9. A fuel injection system for air-compressing internal combustion engines, having an injection pump and an injection valve connected to one another by an injection line; said fuel injection system comprising:

a metering piston unit, being arranged close to said injection valve, comprising a housing having a cylinder chamber and a piston positioned in said cylinder chamber, said metering piston unit connected in series between said injection pump and said injection valve within said injection line, with a volume of said cylinder chamber corresponding to a pre-injection quantity of fuel, said metering piston unit further having a control opening that connects to said cylinder chamber;

a time-delay member having an inlet and an outlet, and being connected in parallel to said metering piston unit, with said inlet of said time-delay member being connected to said control opening of said metering piston unit, when said piston of said metering piston unit is displaced from a resting position thereof by a given distance, and with said outlet being connected to said injection line at a position between said metering piston unit and said injection valve, said time-delay member being in the form of a plurality of Helmholtz resonators in a serial connection;

a first check valve connected in series with said time-delay member before said outlet, said first check valve being open in a direction towards said injection valve;

a pressure connection for connecting said injection pump to said injection line;

a pressure wave generator connected in series between said pressure connection and said metering piston unit; and a volume reservoir branching off said injection line between said pressure connection and said pressure wave generator, with an actuating pressure of said volume reservoir being smaller than an actuating pressure of said pressure wave generator.

10. A fuel injection system according to claim 1, wherein said time-delay member is in the form of a by-pass line.

11. A fuel injection system according to claim 9, wherein said Helmholtz resonators are respectively comprised of first and second cylindrical disks, with said first cylindrical disks having a concentric bore and with said second disks having a frustum-shaped bore, said first and second disks being stacked such that subsequent to one of said first disks two of said second disks are arranged, with said two second disks being positioned mirror-symmetrical to one another so that said frustum-shaped bores thereof form a respective resonance volume of said Helmholtz resonators.

12. A fuel injection system according to claim 9, wherein said serial connection of said Helmholtz resonators is in the form of a cylindrical body having an axially extending central bore and a plurality of radially extending bores spaced at a distance from one another, said radially extending bores forming a respective resonance volume of said Helmholtz resonators.

13. A fuel injection system according to claim 9, wherein said volume reservoir is comprised of a cylinder and a displacement piston axially slidably arranged in said cylinder, said displacement piston being prestressed by a spring, with a pre-stress of said spring being selected such that said actuating pressure of said displacement piston is smaller than said actuating pressure of said pressure wave generator.

14. A fuel injection system according to claim 9, further comprising:

a second check valve provided downstream of said metering piston unit, allowing fuel flow only in the direction of said injection valve; and wherein said metering piston unit further comprises:

a pressure spring disposed inside said housing for maintaining said piston in a resting position thereof, with a stroke of said piston being limited by an abutment provided at said housing, said piston being axially slidably arranged in said cylinder chamber.

* * * * *